United States Patent [19]

Hahne

[11] Patent Number: 4,567,697

[45] Date of Patent: Feb. 4, 1986

[54] UTILITY VAULT COVER SEAL

[76] Inventor: Walter B. Hahne, 4600 Roxbury Rd., Corona del Mar, Calif. 92625

[21] Appl. No.: 559,306

[22] Filed: Dec. 8, 1983

[51] Int. Cl.[4] ..... E02D 29/14

[52] U.S. Cl. ..... 52/19; 52/20; 49/465; 404/25

[58] Field of Search ..... 52/19, 20, 21, 393; 404/24, 25, 26; 49/485, 465

[56] References Cited

U.S. PATENT DOCUMENTS

| | | | |
|---|---|---|---|
| 175,725 | 4/1876 | Mecklenberg . | |
| 1,804,787 | 5/1931 | Kullmer | 49/485 |
| 1,987,502 | 1/1935 | Born et al. . | |
| 2,488,796 | 11/1949 | Baier . | |
| 2,663,268 | 12/1953 | Ahnell . | |
| 4,186,056 | 1/1980 | Muller et al. | 49/485 |

FOREIGN PATENT DOCUMENTS

| | | | |
|---|---|---|---|
| 507489 | 12/1954 | Italy | 49/485 |
| 518009 | 8/1939 | United Kingdom . | |
| 529826 | 5/1940 | United Kingdom . | |

*Primary Examiner*—Carl D. Friedman
*Assistant Examiner*—Creighton Smith
*Attorney, Agent, or Firm*—Knobbe, Martens, Olson & Bear

[57] ABSTRACT

In a rectangular utility vault cover a continuous flange on the underside of the cover presses against a sealing material contained in a channel mounted on the vault casing to form a non load bearing seal on the vault cavity. A raised ramp or cam located at each corner of the cover rides upon a raised track on the casing so that the projecting flange does not abrade the sealing material as the cover is slidably removed from the vault casing.

20 Claims, 7 Drawing Figures

Fig. 1
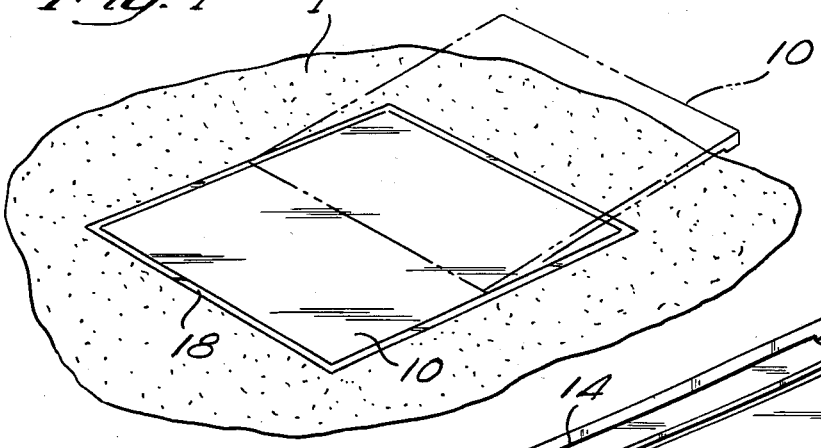
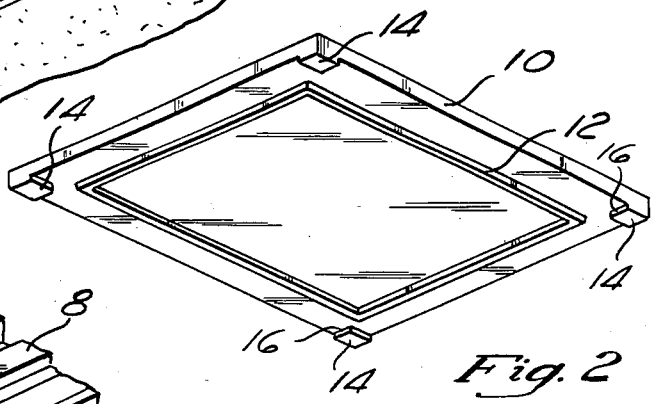
Fig. 2
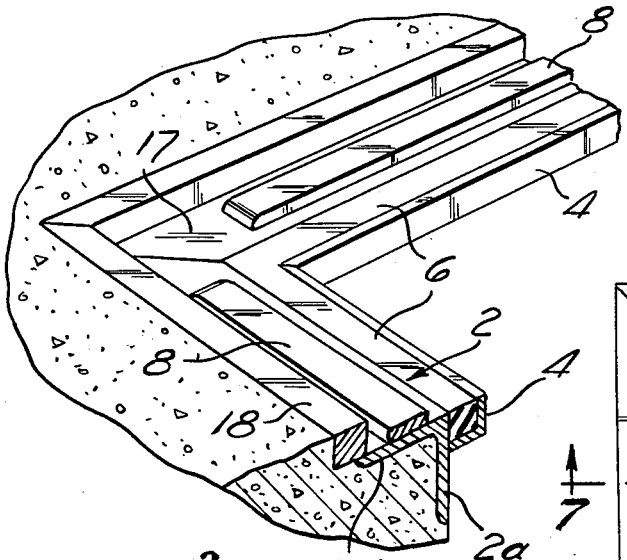
Fig. 3
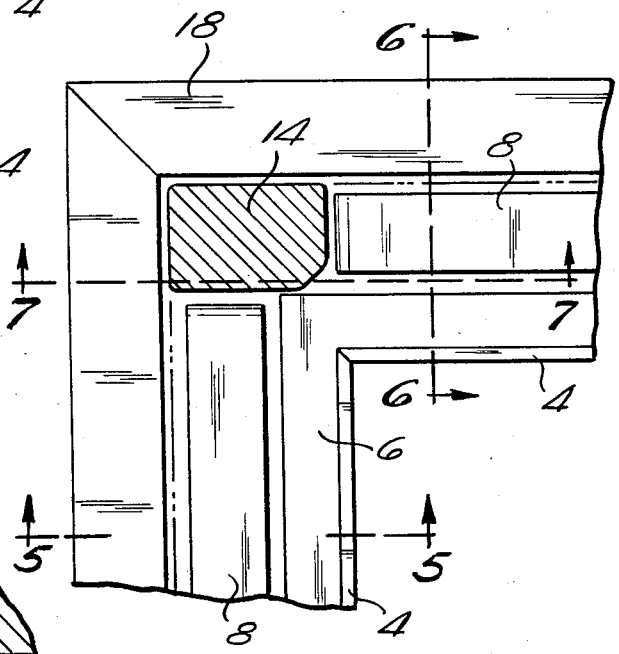
Fig. 4
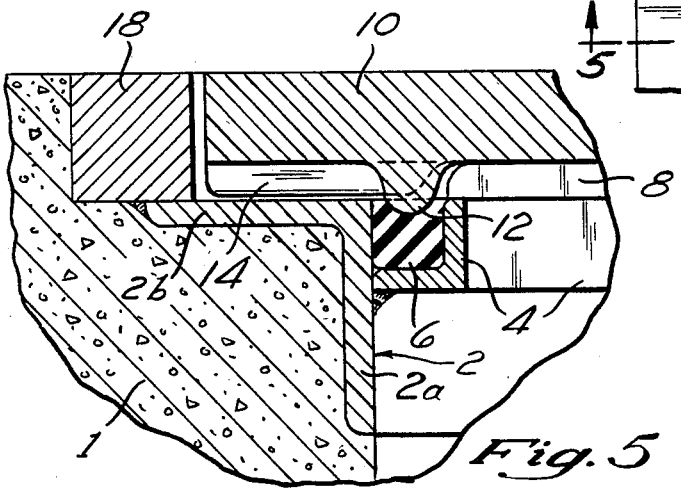
Fig. 5

UTILITY VAULT COVER SEAL

BACKGROUND OF THE INVENTION

Utility vault covers, or manhole covers, are typically round or rectangular, but can be of various shapes. The covers are usually made of cast metal or concrete and are typically quite heavy. Thus the covers are removed by sliding the cover off the underlying vault casing.

Various types of seals have been unsatisfactorily used in an attempt to provide a long lived seal which can prevent water from entering the utility vault. If a sealing gasket is used between the vault cover and the vault in a load bearing capacity, the gasket deteriorates as traffic over the vault cover causes the gasket to abrade. Non load bearing seals, such as O-ring seals are useful on round vault covers. When O-rings are used on non-circular vault covers, however, the O-ring is unseated or damaged when the non-circular length of the seal is pulled or abraded as the cover is slidably withdrawn.

There thus exists a need for a utility vault cover seal which is applicable to non-circular covers, and which can withstand repeated use as the vault cover is slidably removed.

DESCRIPTION OF THE DRAWINGS

FIG. 1 is a perspective of a rectangular utility vault cover insitu;

FIG. 2 is a perspective of the lower side of the rectangular utility vault cover of this invention;

FIG. 3 is a perspective sectional view of one corner of the utility vault of this invention;

FIG. 4 is a top view of the cover shown in FIG. 3, with the cover corner pads in cross-section;

FIG. 5 is a sectional view on line 5—5 of FIG. 4 showing a projecting lip resting against a sealing material;

SUMMARY OF THE INVENTION

Figure 6:
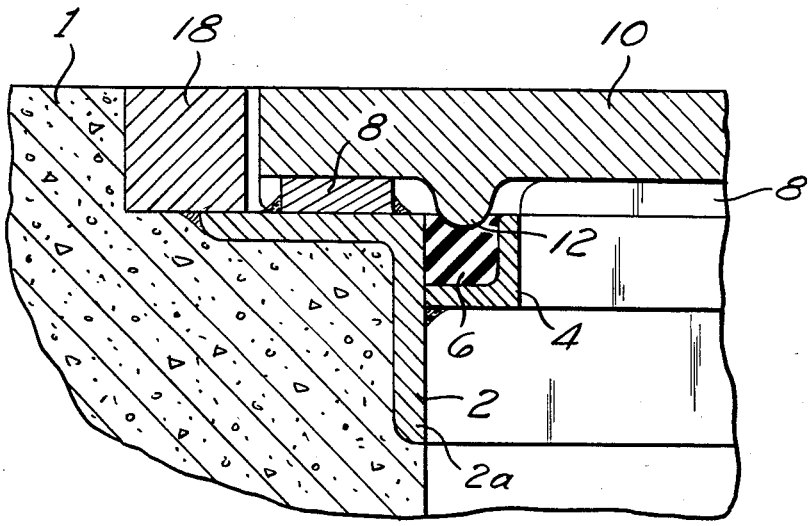
FIG. 6 is a sectional view on line 6—6 of FIG. 4.

A frame is placed into the rectangular opening of a utility vault cover when the concrete vault is poured. The frame has a piece of angle iron which provides a metal exterior corner around the vault opening. On the vertical part of this frame, a continuous bracket is attached so that a sealing material can be placed in the bracket to form a continuous seal around the inside of the frame. A raised section or track is placed along the horizontal sections of the frame. This track is discontinuous near the corners of the frame.

A utility vault cover is provided having a shape corresponding to the vault frame. On the lower side of the cover is a continuous projection, or flange, corresponding to the location of the sealing material held by the frame. When the cover is set onto the frame, the projection contacts the sealing material to form a non load-bearing, water tight seal.

On the bottom corners of the cover are located four raised areas or pads which fit into the space formed by the track discontinuities at each corner. The height of the pads corresponds to the height of the track such that the utility vault cover rests upon the track or rests upon both the track and the four pads. The cover is of sufficient strength so that vehicular traffic loads on the cover are primarily transmitted through the cover to the track, and through the raised pads if they also contact the frame. Thus, the seal between the continuous projection and the sealing material is non load bearing.

The four pads and the ends of the tracks have inclined or ramped edges such that when the cover is slid off of the frame, the pads ramp up onto the track. The height of the pads and the height of the projection are such that when the pads rise up onto the track, the projection does not abrade the sealing material or any portion of the vault frame or vault casing.

There is thus provided a method for providing a continuous water-tight seal to a utility vault cover. That seal is non-load bearing and is not abraded when the vault cover is slidably removed. Thus, the sealant material will have a prolonged operational life.

DESCRIPTION OF THE INVENTION

This invention relates to utility vault covers as shown in FIG. 1. Due to the weight of these covers, they are typically removed by sliding the cover off of the vault opening as shown in FIG. 1.

A metal frame 2 is typically cast into a concrete vault 1 when the concrete is poured. It is also possible, however, to retrofit the frame 2 of this invention to an existing vault. The frame, vault cover, and vault opening are non-circular, typically having a rectangular shape as shown in FIG. 1.

The vault frame 2 has a vertical leg 2*a* and a horizontal leg 2*b* which join at substantially right angles as does a piece of angle iron. The two legs form an exterior corner around the inside of the vault opening. A continuous channel or bracket 4 is fastened to the top portion of the vertical leg 2*a*. The bracket 4 extends around the inside of the vault cover and can be continuously or intermittently fastened to the vertical leg 2*a*. The continuous bracket 4 can be formed by using an angle iron with the lower horizontal leg fastened to the vertical leg 2*a* of frame 2, while the upper leg of the bracket is vertically oriented as illustrated in FIG. 3.

The top edge of the continuous bracket 4 is substantially the same height as the top of the horizontal leg 2*b* of frame 2, although this height can vary. The continuous bracket 4 contains a sealing material 6 which is also substantially the same height as the top of horizontal leg 2*b* of frame 2. The sealing material 6 is typically a rubber or polymer type sealant which is commonly available.

A raised track 8 is fastened to the top of the horizontal leg 2*b* of frame 2 as shown in FIG. 3. The track 8 is discontinuous at the corners of the vault 1 or vault frame 2, so that a space or recess 17 is formed between each of the ends of the track and the adjacent sides.

Referring to FIG. 2 there is shown a utility vault cover 10 of this invention. The vault cover 10 is typically of a cast metal but could be made of concrete or other materials. A substantially continuous, downwardly extending flange or projection 12 is on the lower surface of vault cover 10. The projection 12 is located on the vault cover 10 such that when the vault cover is set into the vault frame 2, the projection bears against the sealing material 6 without substantially damaging the seal 6 as illustrated in FIGS. 5 and 6. A seal is formed when the exterior of the projection 12 forms a sealing surface bearing against sealing material 6. The cross sectional shape of the projection 12 is hat shaped, as shown in FIGS. 5 and 6. A variety of shapes are suitable so long as the shape does not unduly cut, abrade, or damage the sealing material 6.

As shown in FIG. 2, the shape of the projection 12 on the cover 10 is a continuous rectangular. However, such need not always be the case so long as the projection 12 coincides with the sealing material 6 contained in bracket 4 to form a substantially continuous seal. It is possible, for example, to eliminate the rectangular corners and use more rounded corners. The elimination of sharp corners would also apply to the frame 2 and would facilitate the integral casting of frame 2 and bracket 4 and also minimize the stress risers inherent in sharp corners.

Referring again to FIG. 2, there is also shown depending pads 14 located on the lower surface at the corners of vault cover 10. The discontinuities in the raised track 8 allow the pads 14 to fit into the space between the discontinuous tracks as shown in FIG. 4. The height of the track 8 and the pads 14 are such that the vault cover 10 rests substantially on the track 8. Thus, the seal between projection 12 and sealing material 6 is substantially non load bearing. The height of the pad 14 can be such that loads exerted on vault cover 10 are transferred through the pads 14 to the frame 2 in addition to the loads being transferred through track 8. It is also possible, but not the preferred mode, to make the pads 14 sufficiently high so that the vault cover 10 does not typically contact the raised track 8. In this mode, substantially all of the loads exerted on vault cover 10 would be transferred through pads 14 to the vault frame 2.

When the vault cover 10 is properly installed, a sealing surface on the projection 12 contacts the sealing material 6 to form a water-tight seal for the utility vault 1. The lower surface of the utility vault cover 10 is substantially parallel to the frame 2 and to the outer frame 18 which is attached to the outer edge of horizontal leg **2*b* of frame 2. The outer frame 18 is typically made of metal and provides a continuous metal interface around the vault cover 10. It is possible to eliminate the outer metal frame 18 although this would result in the possibility of vault cover 10 abrading against the concrete vault 1** and subsequently damaging the edges of the concrete vault.

Figure 7:
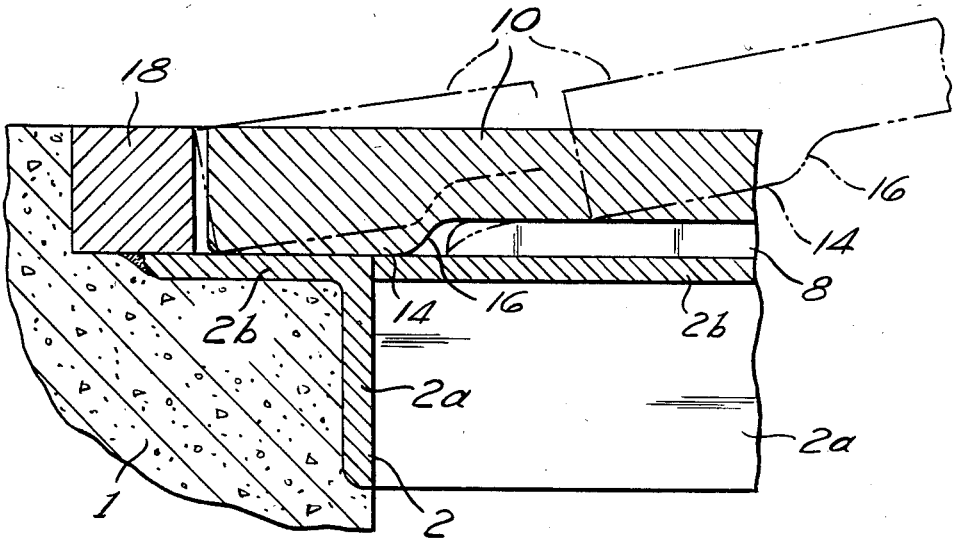
FIG. 7 is a sectional view on line 7–7 of FIG. 4 showing the ramp in phantom sliding on the track of this invention.

As shown in FIG. 7, the pads 14 have a ramped edge 16. Thus, when the vault cover 10 is slidably removed to uncover the vault 1, the ramp 16 allows the pads 14 to ride upon the raised tracks 8 and separating the sealing surface on the projection 12 from the sealing material 6 and thereby prevent the continuous projection 12 from abrading the sealing material 6. Additionally, when pads 14 ride upon the tracks 8, the projection 12 is prevented from abrading against other portions of the vault frame 2 or the continuous bracket 4. There is thus provided interengaging means on the cover and frame for permitting slidable removal of the vault cover 10 yet minimizing the abrasion and damage to the sealing material 6 and the projection 12. Thus, the life of the seal between the continuous projection 12 and the sealing material 6 is prolonged. A further variation of this invention is shown in FIG. 7, wherein the end of the track 8 adjacent the pad 14 is shown in phantom as being tapered or inclined to facilitate the ramping of the pad onto the track.

As will be apparent to one skilled in the art, there are numerous variations which can be made upon this invention without departing from the spirit of the invention. For example, the shape of vault cover 10 need not be rectangular but can have the ends rounded rather than at right angles. Another variation would be to have the pads 14 set into a recess in the frame 2 so that the horizontal leg **2*b* of the frame essentially constituted the raised track 8**.

With yet another variation, the channel 4 need not have its inner vertical wall, but instead have only a horizontal wall or ledge supporting a gasket adhered to the ledge in some suitable manner. This design is particularly appropriate when the frame and the cover are made of materials lighter than iron or steel, such as a reinforced plastic and mortar (often referred to as "rpm"). Such lighter weight construction is useful for vault covers which need not support vehicle traffic.

I claim:

1. An assembly comprising:

a frame forming a rectangle;

a raised portion on at least two opposing sides of said frame, each raised portion extending along said side, but leaving a space between at least one of the adjacent sides and the raised portion;

a bracket on said frame for holding a sealing material;

a cover for said frame;

a projection on the lower surface of said cover that coincides with the location of said bracket to sealably contact said sealing material when the cover is placed over the frame;

a depending portion on the lower surface of said cover on at least two adjacent corners, the location of the depending portions coinciding with the spaces between the raised portions and the adjacent sides when the cover is placed over the frame, the depending portions cooperating with the raised portions to raise the projection so it does not abrade the sealing material as the cover is slidably removed, said depending and raised portions further comprising to transmit substantially all the loads asserted on said cover to said frame.

2. The assembly as defined in claim 1 further comprising a utility vault core onto which said frame is mounted to provide removable access to said vault.

3. The assembly as defined in claim 1 wherein said raised portion extends substantially the full length of said side.

4. The assembly as defined in claim 2 wherein said frame is precast into a utility vault core made of concrete.

5. The assembly as defined in claim 2 wherein said rectangular frame comprises:

a rim portion with a top surface substantially even with the top of said cover;

a horizontal portion connected to the lower portion of said rim, extending inward of said rectangle, and containing said raised portions.

6. A rectangular utility vault cover and frame comprising:

a raised track on at least two opposing sides of said frame which track is discontinuous at at least two adjacent corners to form a space between the track and the adjacent side;

a bracket mounted on said frame supporting a sealing material;

a substantially continuous projection on the lower surface of said cover located so as to coincide with the location of the sealing material and cooperating with the sealing material to form a seal when the cover is mounted on said frame;

at least two depending pads on the lower surface of said cover at adjacent corners, so that the pads fit into said spaces when the cover is installed, but when the cover is slidably removed the pads ramp up onto said raised portion to raise the cover so that the projection does not abrade said sealing material.

7. A rectangular utility vault cover and frame as defined in claim 6 wherein said frame is precast into a concrete vault.

8. A rectangular utility vault cover and frame as defined in claim 6 wherein said cover has four raised pads fitting into four spaces, one space being located at each of the four corners of said rectangular frame.

9. An assembly comprising:

a rectangular frame made of angle iron having a horizontal portion and an inward portion extending down;

at least one pair of raised tracks on opposing sides of said horizontal portion but discontinuous at at least two adjacent corners so that a space is formed between the end of the track and the adjacent side;

a bracket mounted on the inside of said rectangular frame;

a sealing material mounted in said bracket;

a cover for placing over said rectangular frame;

a substantially continuous projection depending from the lower surface of said cover so that the continuous projection contacts said sealing material to form a seal when said cover is placed on said rectangular frame;

at least two depending pads on the lower surface of said cover at adjacent corners, said pads dimensioned so that they fit into the spaces between the end of said raised tracks and the adjacent side, said pads having a ramped portion so that the pads can ramp up onto said raised tracks as the cover is slidably removed, the height of said pads and track being sufficient to raise the continuous projection so that the projection does not abrade the sealing material as the cover is slidably removed.

10. An assembly as defined in claim 9 wherein said rectangular frame is precast into a concrete vault.

11. An assembly as defined in claim 9 wherein the end of said track is tapered so as to facilitate the ramping of said pad onto said track.

12. An assembly as defined in claim 9 wherein the height of said pads and raised track cooperate to provide a substantially non load bearing seal between the projection and the sealing material, with said track carrying substantially all the transmitted loads.

13. A rectangular utility vault cover and frame comprising:

a raised track mounted around the frame, the track being discontinuous at each corner so that a space is formed between the end of the track and the adjacent side;

a bracket connected to the frame;

a sealing material mounted in the bracket;

a substantially continuous projection depending from the lower surface of the cover, the location of the projection coinciding with the location of the sealing material to provide a seal when the cover is placed on the frame;

four depending pads on the corners of the lower surface of said cover, the pads dimensioned so that they fit into the space formed between the ends of the raised tracks and the adjacent sides, the pads cooperating with the tracks so that as the cover is slidably removed the pads ramp up onto the tracks so as to raise the continuous projection and prevent damage to the sealing material.

14. A rectangular utility vault cover and frame as defined in claim 13 wherein the seal between the continuous projection and the sealing material is substantially non load bearing, with substantially all the loads being carried by the track portion.

15. A rectangular utility vault cover and frame as defined in claim 13 wherein the ends of the tracks, and the edges of the pads are inclined to facilitate the ramping of the pads onto the tracks.

16. A utility vault cover and frame comprising:

a rectangular frame means mounted on a vault opening;

bracket means mounted on said frame, for supporting a sealing material;

a continuous projection depending from the lower surface of said vault cover so that said projection contacts said sealing material to form a seal;

recessed areas at each corner of said frame;

depending pads on the lower surface of said cover at each corner corresponding to the location of said recessed areas so the pads fit into the recesses when said cover is on said vault, said pads and recesses cooperating so the pads can ramp out of said recessed area onto said frame as the cover is slidably removed, said cover raising up onto said pads to disengage said continuous projection from said sealing material and thereby prevent damage to said sealing material.

17. A utility vault cover and frame as defined in claim 16 wherein said rectangular frame is cast integrally with a concrete utility vault as the concrete is poured.

18. A utility vault cover and frame as defined in claim 16 wherein the sides of said recesses, and the edges of said pads, are shaped to facilitate the ramping of said pads onto said tracks.

19. An assembly for providing access to a utility vault or underground cavity comprising:

a rectangular frame defining an opening;

a cover supported on the frame covering the opening and being slidable on the frame to uncover the opening;

a seal on said cover and frame for restricting water flow through the opening including seal material and a sealing surface engaging the material when the cover is placed on the frame covering the opening, the sealing surface and seal material being located so that the seal is substantially non-load bearing; and interengaging track and pad means on said frame and cover for separating the sealing surface and the seal material when the cover is slidably removed, thereby preventing the seal material from being damaged as the cover is being removed.

20. The assembly of claim 19 wherein:

said seal includes means on said frame supporting the seal material, and a depending projection on said cover forming said sealing surface; and said interengaging track and pad means includes means for raising the projection to separate its sealing surface from the seal material as one edge of the cover is raised and a lateral force is applied to the cover to slide it across the frame.

* * * * *